US006276948B1

(12) United States Patent
Okabe

(10) Patent No.: US 6,276,948 B1
(45) Date of Patent: Aug. 21, 2001

(54) CONNECTOR SUPPORTING MECHANISM

(75) Inventor: Toshiaki Okabe, Shizuoka-ken (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/583,012

(22) Filed: May 30, 2000

(30) Foreign Application Priority Data

May 31, 1999 (JP) ..... 11-152793

(51) Int. Cl.[7] ..... H01R 13/62
(52) U.S. Cl. ..... 439/157; 439/372
(58) Field of Search ..... 439/152, 153, 439/154, 157, 160, 310, 372

(56) References Cited

U.S. PATENT DOCUMENTS

| | | | | |
|---|---|---|---|---|
| 171,120 | * | 1/2001 | Bolich et al. | 439/157 |
| 193,531 | * | 2/2001 | Ito et al. | 439/157 |
| B1 193,531 | * | 2/2001 | Ito et al. | 439/157 |
| 5,954,532 | * | 9/1999 | Matsuura et al. | 439/372 |
| 6,120,308 | * | 9/2000 | Hayashi | 439/157 |
| 6,126,470 | * | 10/2000 | Ono | 439/310 |
| 6,164,991 | * | 12/2000 | Matsuura et al. | 439/157 |

FOREIGN PATENT DOCUMENTS 10-021992 1/1998 (JP) .

* cited by examiner

*Primary Examiner*—Brian Sircus
*Assistant Examiner*—Thanh-Tam Le
(74) *Attorney, Agent, or Firm*—Finnegan, Henderson, Farabow, Garrett & Dunner, L.L.P.

(57) ABSTRACT

A first connector 20 comprises a connector body 21, and a pair of engaging levers 22 respectively pivotally supported by at least one side surface of the connector body 21 such as to project toward one end of the connector body 21, engaging projections 25 project from one ends of the engaging levers 22, connecting projections 27 project from the other ends of the engaging levers 22, and guide grooves for guiding the connecting projections 27 are formed in the second connector 30, and in a state in which the engaging levers 22 are engaged with a back surface of the mounting panel 10 of a peripheral edge of the mounting opening, the second connector 30 is fitted to the first connector 20, the connecting projections 27 are guided in the guide grooves 32, the pair of engaging levers 22 are turned in a direction in which the engaging levers 22 are separating from each other, and the first engaging projections 25 are strongly supported by a mounting member.

3 Claims, 13 Drawing Sheets

CONNECTOR SUPPORTING MECHANISM

BACKGROUND OF THE INVENTION

1. Field of the Invention

The present invention relates to a connector supporting mechanism, and more particularly, to a connector supporting mechanism for supporting and fixing a pair of female and male mutually connected connectors to a supporting body.

2. Description of the Related Art

Conventionally, as a connector supporting mechanism of this kind, there is known a technique as described in Japanese Patent Application Laid-open No. H10-21992. This prior art has a structure as shown in FIGS. 1 to 3. A connecting mechanism of this conventional connector will be explained with using FIGS. 1 to 3 below.

This connector connecting mechanism comprises a holder 2 mounted into a mounting hole 1A formed in a mounting member 1 such as a stay member of an automobile as shown in FIG. 1, a first connector 3 which is slidably fitted in the holder 2, a second connector 5 connected to an electronic unit 4, and a swinging lever 6 swingably supported at a pivot 6A by the first connector 3 for driving in a direction to the second connector 5 to the first connector 3.

The holder 2 is formed into a substantially cylindrical shape, and includes a pair of upper and lower horizontal plates 7 and 8, and a pair of left and right side plates 9 and 10 as shown in FIG. 1. The holder 2 is inserted into the mounting hole 1A formed in the mounting member 1 and fixed therein by fixing means such as screw. The side plates 9 and 10 of the holder 2 are formed at their inner wall surfaces with guide grooves 11 and 12 along the longitudinal direction for slidably guiding the first connector. The horizontal plate 7 is formed with a guide groove 13 with which an engaging pin 6B projecting from an upper surface of a rear end of the swinging lever 6 is engaged and guided. The guide groove 13 comprises an introducing portion 13A rearwardly extending from a front end of the holder 2, an arc driving grove portion 13B extending from an end of the introducing portion 13A rearwardly and inwardly, and a locking groove portion 13C extending from an end of the driving groove portion 13B rearwardly. The driving groove portion 13B guides the engaging pin 6B along an arc as the first connector 3 is inserted into the holder 2. With the motion of this engaging pin 6B, the swinging lever 6 swings.

An engaging groove 6C is formed in a lower surface of a front end of the swinging lever 6. A driven pin 5A projecting from the second connector 5 engages the engaging groove 6C. Another swinging lever 6 is also formed on the other side surface of the first connector 3. Another driven pin 5A (not shown) is also projecting from the other side surface of the second connector such as to correspond to the other swinging lever formed on the other side surface. In FIG. 1, the reference symbol 3A represents a pair of slide projections projecting from a rear end of each of opposite sides of the first connector 3. The slide projections 3A are guided by the guide grooves 11 and 12 formed in the inner walls of the side plates 9 and 10 of the holder 2. As shown in FIGS. 1 and 3, a temporarily mounting portion 3B for temporarily mounting the first connector 3 into a front opening of the holding is formed between each of the pair of the slide projections formed on both sides of the first connector 3. Further, as shown in FIGS. 1 and 3, a pair of falling-out preventing projections 3C and 3C are projecting from each of the opposite sides of the rear end of upper and lower surfaces of the first connector 3. Falling-out preventing portions 2A are formed on the front end opening peripheral edges of the holder 2 so as to correspond to the falling-out preventing projections 3C and 3C. The projections 3C are fitted into temporarily mounting positions of the holder 2 for preventing the first connector 3 from falling out from the holder 2 by the falling-out preventing portions 2A.

However, according to the connecting mechanism of the connectors, it is necessary to mount the holder 2 to the mounting hole 1A formed in the mounting member 1 before the first connector 3 and the second connector 5 are mounted to the mounting member 1 such as a stay member of an automobile, and there is a problem that the number of parts is increased. Especially, in the prior art, since the swinging lever 6 is rotated and driven if the engaging pin 6B engaged in the guiding groove 13 of the holder 2 is guided, it is necessary to precisely set size and shape of the guide groove 13 formed in the holder 2.

Further, according to the above-described conventional mechanism, in order to temporarily mount the first connector 3 to the holder 2 at an initial position of the inserting motion, it is necessary to form the temporarily mounting portion on the side of the first connector 3. As a result, it is necessary to form the temporarily mounting projection 2B also on the side of the holder 2 as shown in FIG. 3. In addition, in order to prevent the first connector 3 inserted into the initial position of the inserting motion from falling out from the holder 2, it is necessary to form the falling-out preventing projections 3C on the first connector 3, and to form the falling-out preventing portions 2A also on the side of the holder 2. In the conventional mechanism, since the temporarily mounting mechanism and the falling-out preventing mechanism are formed on each of the members, there is a problem that the mechanisms become complicated. Therefore, according to the conventional connector connecting mechanism, since the number of parts is great and mechanisms are complicated, a mounting space is required, and the mounting operation is complicated. For these reasons, in the conventional engaging mechanism, there is a problem that the costs of parts and operational costs are high.

Further, the temporarily mounting portion 3B formed on the first connector 3 and the falling-out preventing portions 2A formed on the holder 2 are portions which are set such that they are resiliently deformed when the first connector 3 is inserted into the holder 2. There is an adverse possibility that these portion may be bent or damaged by strong external force caused when a wire harness connected to the first connector 3 is handled or when the holder 2 and the first connector 3 are assembled at improper position.

Further, in the conventional connector connecting mechanism, when the first connector 3 is inserted into the mounting member 1 such as a stay member of an automobile, it is necessary to fit the engaging pin 6B projecting from the rear end of the swinging lever 6. In the state in which the first connector 3 is inserted into the holder 2 in this manner, since the swinging lever 6 can swing freely, there are problems that some experience is required to insert the engaging pin 6B into the introducing portion 13A of the guide groove 13, and the assembling operation is complicated.

SUMMARY OF THE INVENTION

It is an object of the present invention to provide an inexpensive connector supporting mechanism capable of reducing the number of parts and an assembling operation can easily and reliably be carried out.

According to a first aspect of the present invention, there is provided a connector supporting mechanism comprising a mounting member, a first connector supported by the mounting member, and a second connector fitted to the first connector, wherein the mounting member comprises a mounting panel having a mounting opening, the first connector comprises a connector body, and a pair of engaging levers respectively pivotally supported by at least one side surface of the connector body such as to project toward one end of the connector body, engaging projections project from one ends of the engaging levers, connecting projections project from the other ends of the engaging levers, and guide grooves for guiding the connecting projections are formed in the second connector, and in a state in which the engaging levers are engaged with a back surface of the mounting panel of a peripheral edge of the mounting opening, the second connector is fitted to the first connector, the connecting projections are guided in the guide grooves, and the pair of engaging levers are turned in a direction in which the engaging levers are separating from each other.

With the first aspect, if the second connector is fitted to the first connector supported by the mounting member, the pair of connecting projections projecting from the pair of engaging levers pivotally supported by the first connector slide on the guide grooves formed in the second connector, and the engaging levers are rotated and the engaging projections are separated from each other. As a result, the engaging projections engage the mounting member more strongly, and the first connector is mounted to the mounting member. At the same time, the second connector can be reliably mounted to the first connector.

According to a second aspect of the invention, in the connector supporting mechanism of the first aspect, the pair of guide grooves corresponding to the connecting projections projecting from the pair of engaging levers are formed on an inner wall surface of the second connector, and the guide grooves are extended in a direction in which the guide grooves approach each other in the second connector.

Therefore, with the second aspect, in addition to the effect of the first aspect, it is possible to prevent the engaging levers from coming out from the mounting member without fluctuation because the connecting projections slide on the guide grooves during the operation for fitting the second connector to the first connector. Further, since a force for pushing the second connector into the first connector is also applied to the action for spreading the engaging projections from each other, the force is utilized more efficiently, and the operability can be enhanced.

DESCRIPTION OF THE PREFERRED EMBODIMENT OF THE INVENTION

Figure 1:
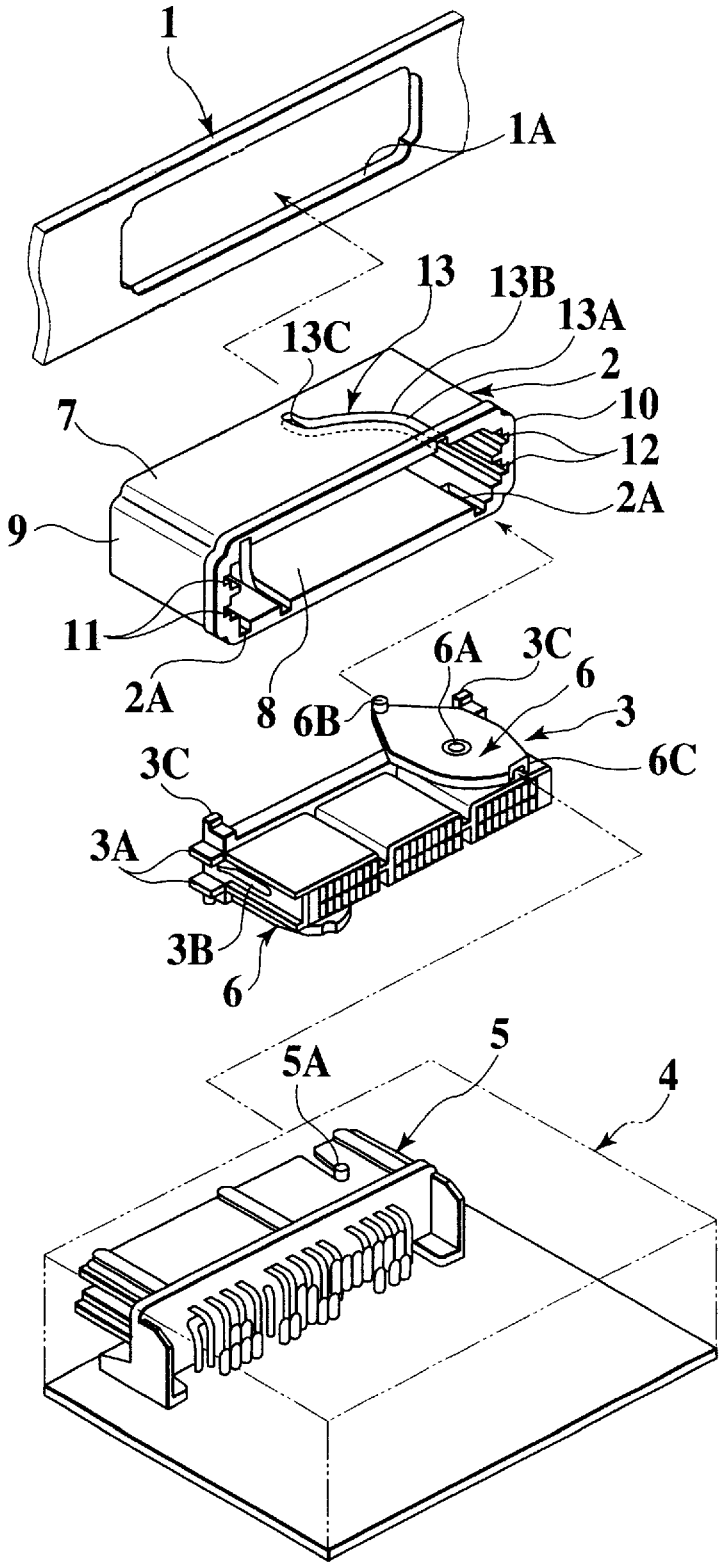
FIG.1 PRIOR ART
FIG. 1 is an exploded perspective view showing a conventional connector supporting mechanism.
Figure 2:
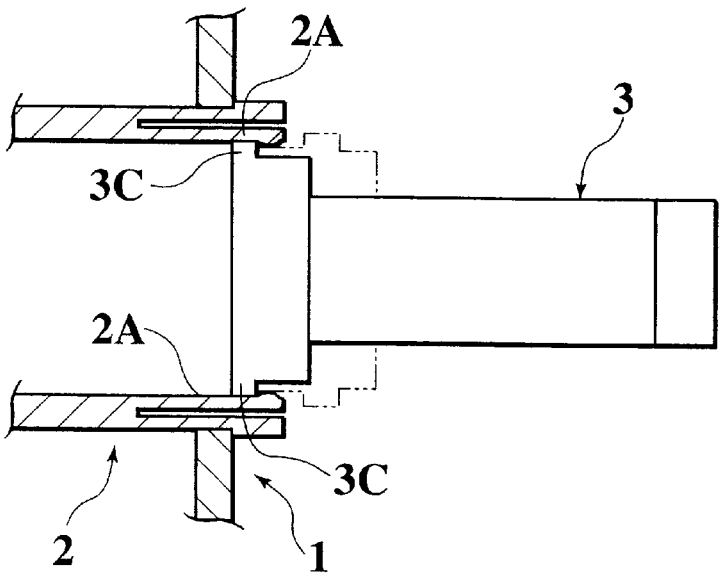
FIG.2 PRIOR ART
FIG. 2 is a partial side sectional view showing the conventional connector supporting mechanism.
Figure 3:
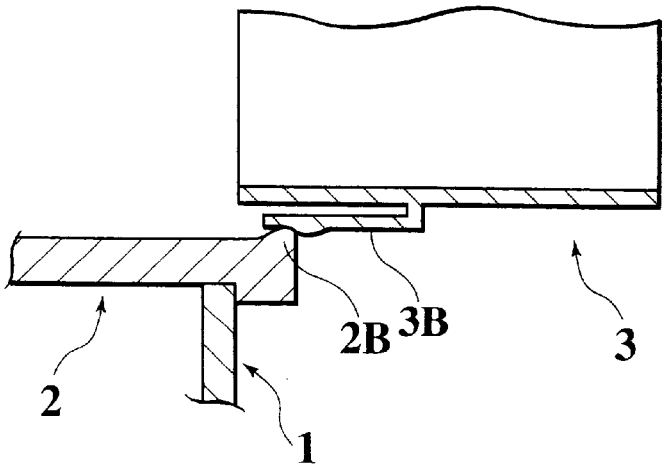
FIG.3 PRIOR ART
FIG. 3 is a plan sectional view of an essential portion of the conventional connector supporting mechanism.

Details of a connector supporting mechanism according to the present invention will be explained based on embodiments shown in the drawings.

(First Embodiment)

FIGS. 4 to 8 show a first embodiment of a connector supporting mechanism according to the present invention.

The connector supporting mechanism of the first embodiment comprises a mounting member 11 formed on a stay member 10 of an automobile for example, a first connector 20 mounted to the mounting member 11, and a second connector 30 fitted to the first connector 20.

Figure 4:
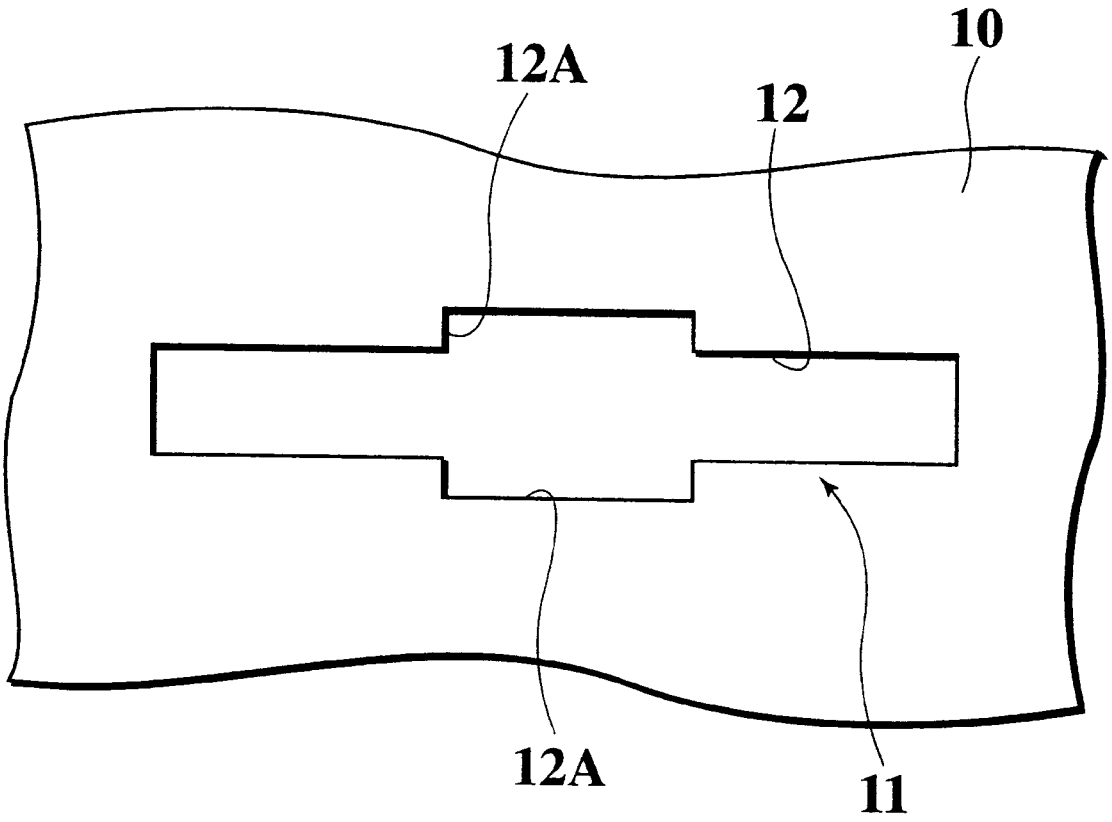
FIG. 4 is a front view showing a mounting member of a first embodiment of a connector supporting mechanism according to the present invention.

As shown in FIG. 4, the mounting member 11 comprises a mounting opening 12 formed in the stay member 10. Centers of upper and lower edges of the mounting opening 12 are formed with insertion notches 12A, respectively.

The first connector 20 comprises a substantially rectangular parallelepiped first connector body 21, and a pair of engaging levers 22, 22 which are respectively pivotally supported by upper and lower surfaces of the first connector body 21.

The first connector body 21 is formed with a connecting space in which a plurality of female terminal metal fittings (not shown) are accommodated. These female fittings are electrically connected to male terminal metal fittings provided on the second connector 30 at the front end of the first connector body 21. Guide projections 23, 23 are formed on opposite sides of upper and lower surfaces of the front end of the first connector body 21.

The engaging levers 22, 22 are turnably pivotally supported by pivots 24, 24 on the upper and lower surfaces of the first connector body 21, respectively. One ends of the engaging levers 22 project rearward of a rear end of the first connector body 21. Each of rear tip ends of the engaging levers 22 is formed with a first engaging projection 25 and a second engaging projection 26. Each of the second engaging projections 26 is located closer to a side of the first connector 20 (outer side in the widthwise direction of the first connector body 21) than a line connecting the first engaging projection 25 and the pivots 24. Temporarily mounting projections 28 project in places on upper and lower surfaces of the first connector body 21. Each of the front tip ends of the engaging levers 22 is formed with a connecting projection 27. The temporarily mounting projections 28 and peripheral edges 22A of the engaging levers 22 engage with each other to temporarily mount the engaging levers 22.

The second connector 30 is of substantially parallelepiped shape, and is provided with the plurality of female terminal metal fittings (not shown) which are coupled to the male terminal metal fitting disposed in the first connector 20 by inserting the first connector 20 in the second connector 30. Guide grooves 32 corresponding to the guide projections formed in the first connector body 21 are formed on opposite sides of upper and lower inner wall surfaces of the second connector 30. Connecting grooves 32 extending inward from opening edges of the second connector 30 are formed in intermediate portions of the upper and lower inner wall surfaces. Each of the connecting grooves 32 comprises an introducing groove 32A straightly extending inward from the opening edge, and a bending groove 32B bending inward from the end of the introducing groove 32A. The pair of connecting grooves 32 are formed in the inner wall surfaces of the second connector 30, and the bending grooves 32B of the connecting grooves 32 are formed such that the bending grooves 32B extend in a direction to approach each other.

Next, assembling method, effect and operation of the mounting member 11, the first connector 20 and the second connector 30 of the first embodiment will be explained.

Figure 5:
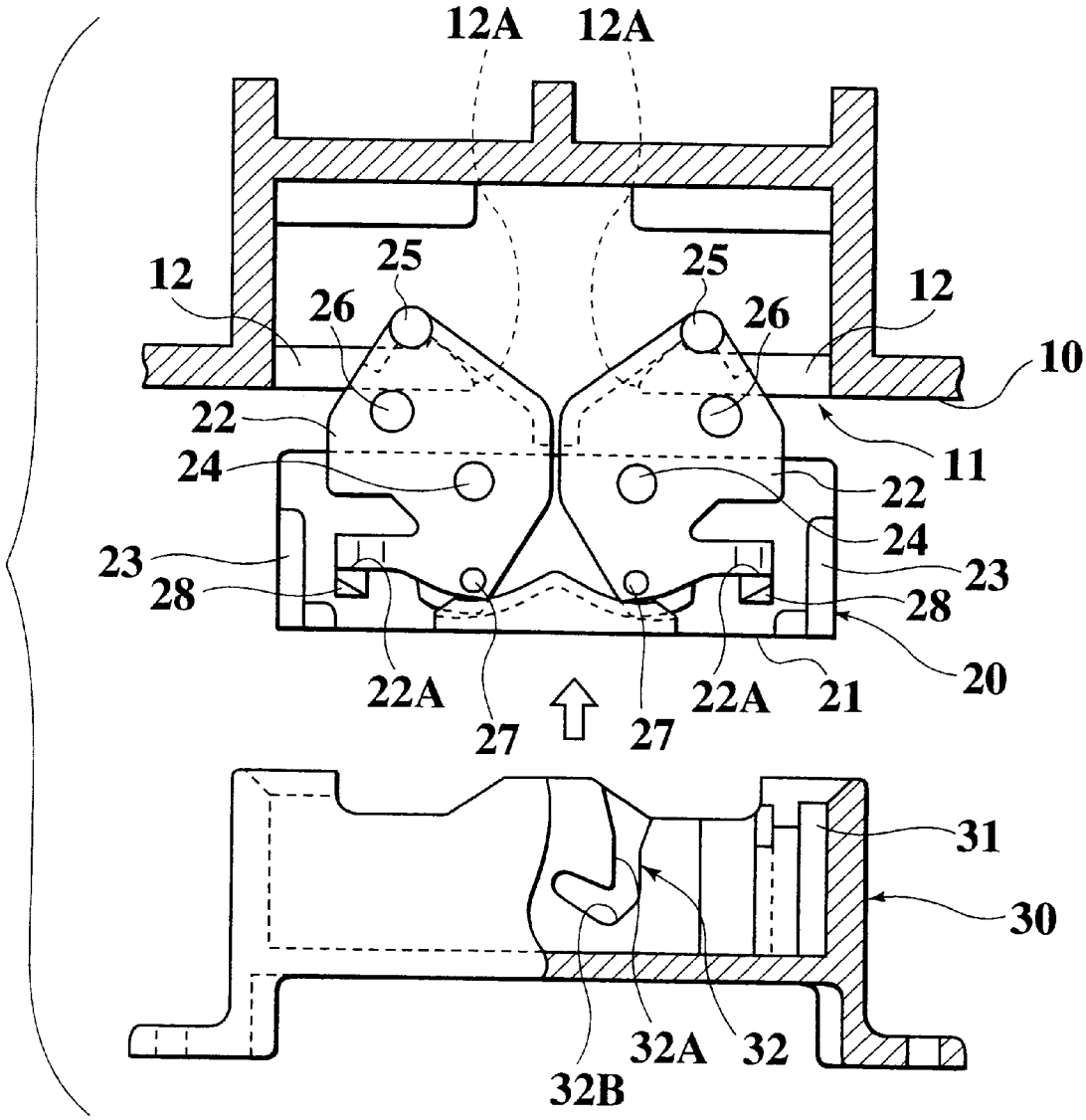
FIG. 5 is a partial sectional plan view showing a state where a second connector is mounted to a first connector which is temporarily mounted to the mounting member in the first embodiment.
Figure 6:
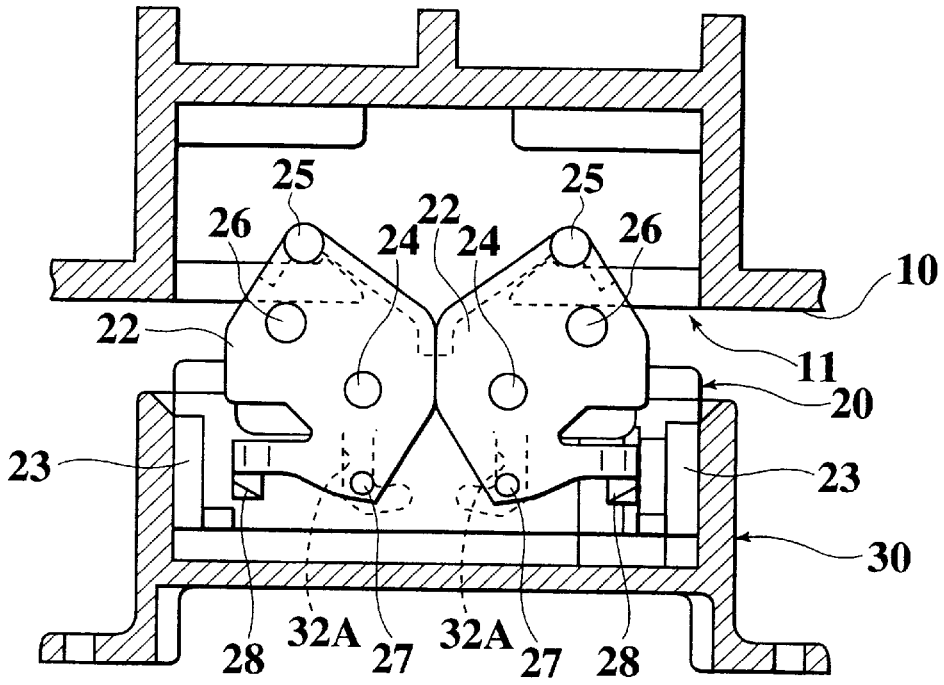
FIG. 6 is a partial sectional plan view showing an intermediate state where the second connector is mounted to the first connector in the first embodiment.

First, as shown in FIG. 4, the first connector 20 is assembled to the mounting member 11 formed on the stay member 10. In this case, the first engaging projections 25 projecting from the upper and lower engaging levers 22 located one side of the widthwise direction of the first connector 20 are once inserted into the insertion notches 12A, 12A, and the other first engaging projections 25 formed on the other upper and lower engaging lever 22 are inserted into the insertion notches 12A, 12A, thereby establishing the temporarily mounting state as shown in FIG. 5. In this state, plate portions of the one side insertion notches 12A are sandwiched between the first engaging projections 25 and the second engaging projections 26 as shown in FIG. 5. Therefore, in this state, the first connector 20 is temporarily mounted to the mounting member 11.

Next, as shown in FIG. 5, the second connector 30 is allowed to approach the first connector 20, and the second connector 30 is fitted to the first connector 20 (see FIG. 14) such that the guide projections 23 formed on the opposite sides of the front end upper and lower surfaces of the first connector body 21 are fitted to the guide groove portions 31 formed on the opposite sides of the upper and lower inner wall surfaces of the second connector 30. At that time, the connecting projections 27 formed on the engaging levers 22 slide and reach the entrance of the curved groove portions 32B in a state where the connecting projections 27 are accommodated in the introducing groove portions 32A formed in the upper and lower inner wall surfaces of the second connector 30.

Figure 7:
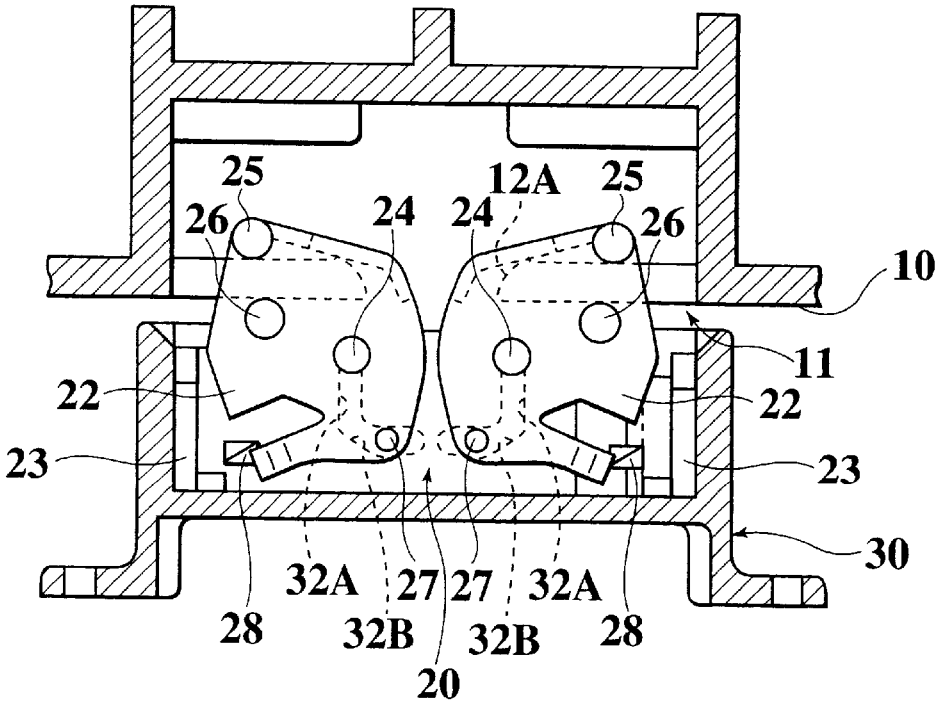
FIG. 7 is a partial sectional plan view showing the intermediate state where the second connector is mounted to the first connector in the first embodiment.
Figure 8:
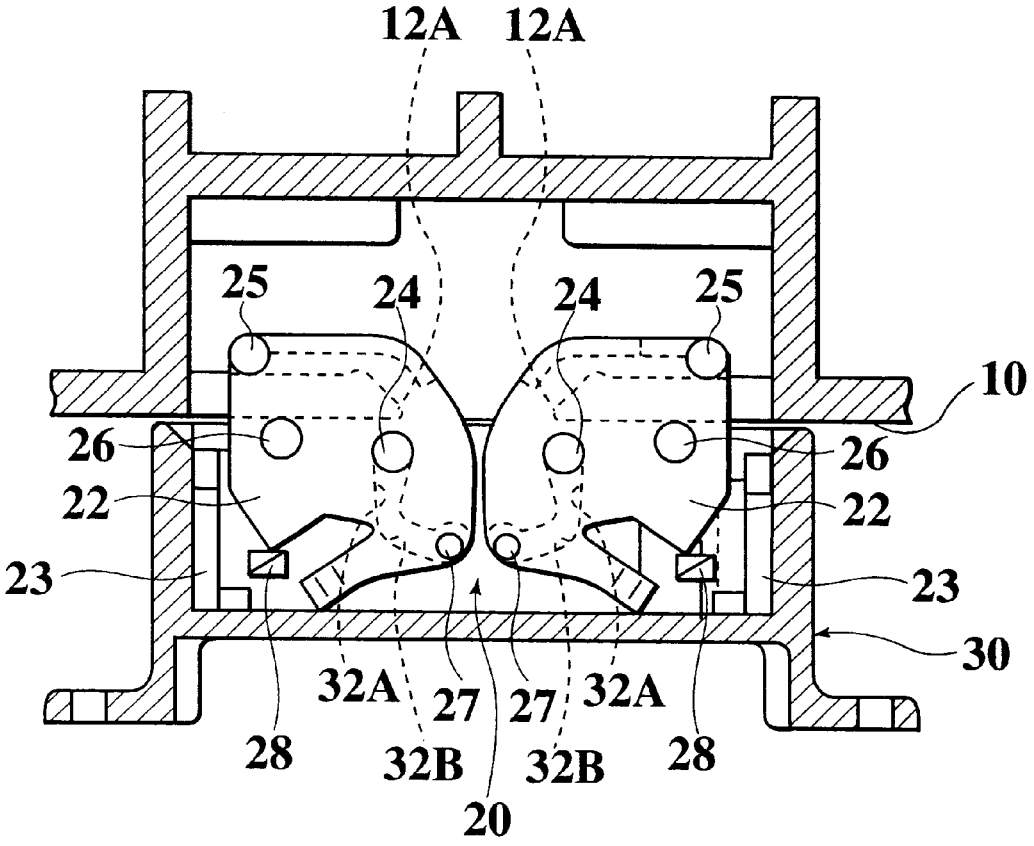
FIG. 8 is a partial sectional plan view showing a state where the second connector is completely mounted to the first connector in the first embodiment.

Thereafter, if the second connector 30 is further pushed and fitted to the first connector 20 as shown in FIG. 7, the connecting projections 27 rotate and move along the curved surfaces of the curved groove portions 32B to turn the engaging levers 22. The engaging levers 22, 22 rotate in a direction in which first engaging projections 25 are separated from each other in accordance with the shapes of the curved groove portions 32B. If the first engaging projections 25 are separated from each other and the engaging levers 22 are turned, the first connector 20 is pulled toward the mounting member 11 around the first connector engaging projections 25 as fulcrums. If the second connector 30 is further pushed, as shown in FIG. 8, the connecting projections 27 reach the terminations of the curved groove portions 32B, and with this movement, the engaging levers 22 further rotate in a direction separating the first engaging projections 25 away from each other. Then, the engaging levers 22 get over the temporarily mounting projections 28 formed on the first connector body 21 and the peripheral edges abut against the temporarily mounting projections 28 so as to prevent the engaging levers 22 from easily rotate in the opposite direction. In this state, the first connector 20 most approaches the mounting member 11 , the plate member of the stay member 10 is sandwiched between the first engaging projections 25 and the second engaging projections 26, and the first connector 20 is strongly fixed. In this state, the second connector 30 is fitted to the first connector 20 completely, and the assembling operation is completed. As a result, the female terminal metal fitting of the first connector 20 and the male terminal metal fittings of the second connector 30 are connected to each other, and the electrical connection is established.

According to the first embodiment, since the mounting member 11 can be sandwiched and temporarily mounted between the first engaging projections 25 and the second engaging projections 26 projected from the rear end of the engaging levers 22, the mounting operation of the connectors is extremely easy, and the connector can be supported with a single motion. Further, in the first embodiment, the first connector 20 can be supported by and fixed to the mounting member 11 simultaneously only by fitting the second connector 30 to the first connector 20. Therefore, there is a merit that skill is not required for the operation, and the connectors can be supported reliably.

(Second Embodiment)

FIGS. 9 to 19 show a second embodiment of the connector supporting mechanism of the present invention.

The connector supporting mechanism of the second embodiment comprises a mounting member which is the same as that of the first embodiment, a first connector 40 mounted to the mounting member, and a second connector 50 fitted to the first connector 40.

Figure 9:
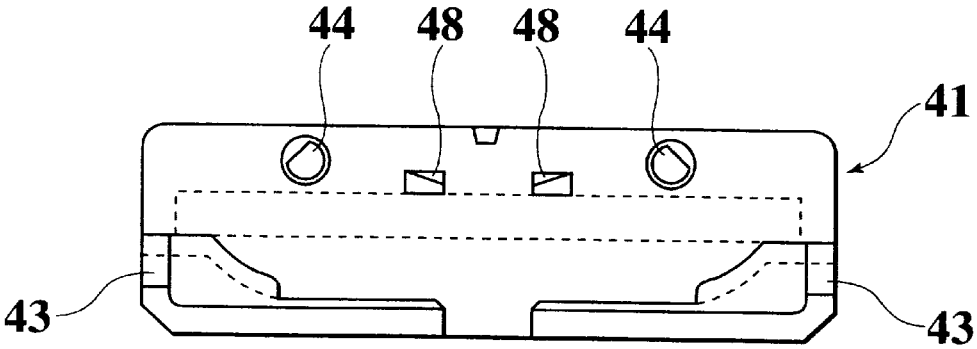
FIG. 9 is a plan view of a first connector body in a second embodiment of the connector supporting mechanism according to the present invention.
Figure 10:
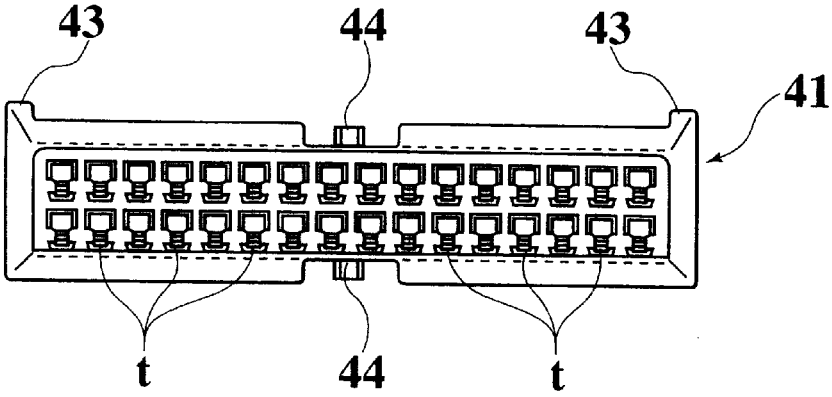
FIG. 10 is a front view of the first connector body of the second embodiment.
Figure 11A:
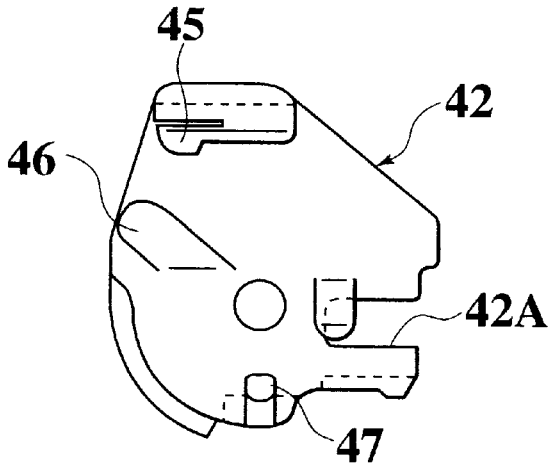
FIG. 11A is a plane view of an engaging lever of the second embodiment.
Figure 11B:
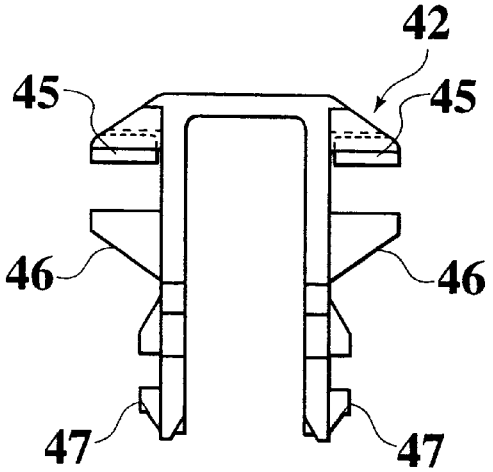
FIG. 11B is a side view thereof.
Figure 11C:
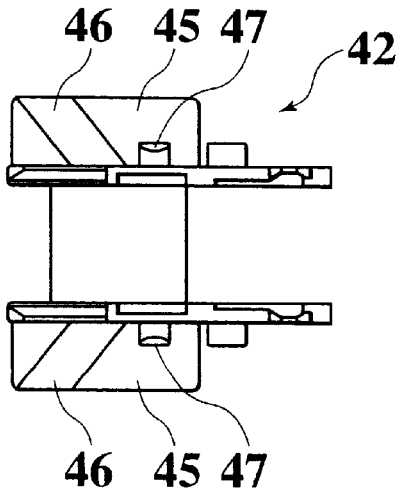
FIG. 11C is a front view thereof.
Figure 12:
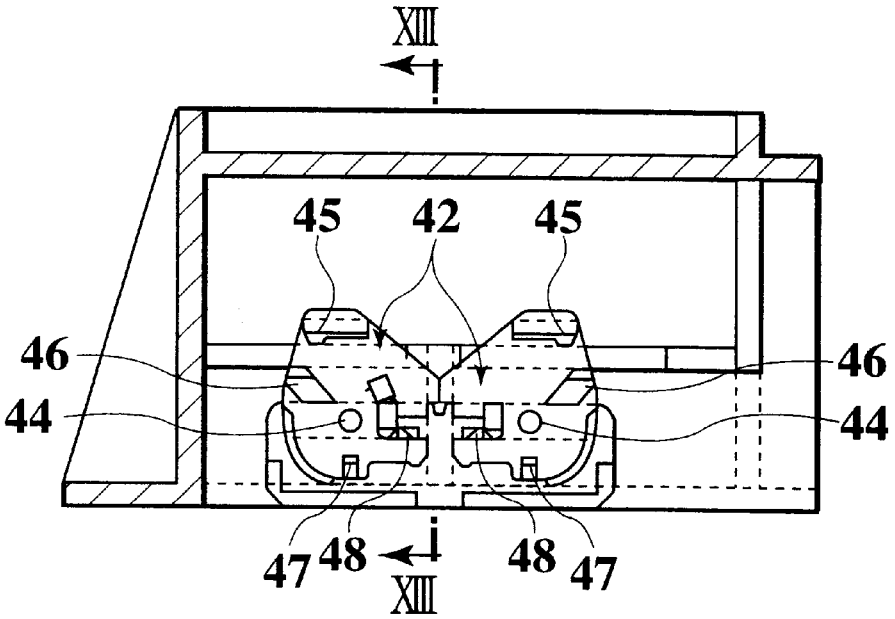
FIG. 12 is a partial sectional plan view showing a state where a first connector is temporarily mounted to a mounting member in the second embodiment.
Figure 13:
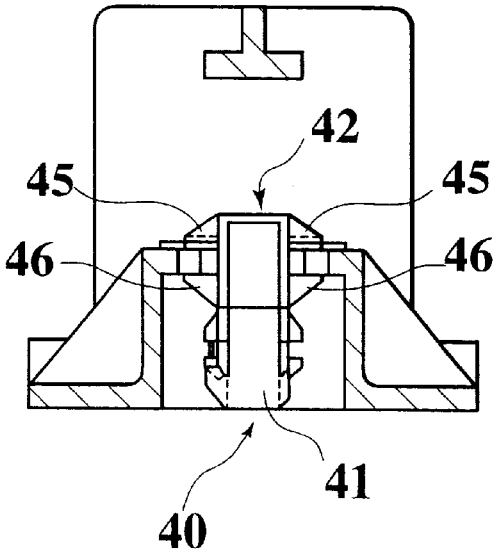
FIG. 13 is a sectional view taken along the ling XIII—XIII in FIG. 12.

The first connector 40 comprises a substantially rectangular parallelepiped first connector body 41 as shown in FIGS. 9 and 10, and a pair of engaging levers 42, 42 formed on upper and lower surfaces of the first connector body 41. FIG. 9 is a plan view of the first connector body 41, FIG. 10 is a front view of the first connector body 41, FIG. 11A is a plane view of the engaging lever 42, FIG. 11B is a side view thereof, and FIG. 11C is a front view thereof.

As shown in FIG. 10, the first connector body 41 is formed with a terminal accommodating chamber in which a plurality of female terminal metal fitting t are accommodated. These female terminal metal fittings t are electrically connected to female terminal metal fittings (not shown) of the second connector 50 at the front end of the first connector body 41. Guide projections 43, 43 are formed on opposite sides of upper and lower surfaces of front end of the first connector body 41.

A side surface of each of the engaging levers 42 is formed into substantially U-shape over the upper and lower surfaces of the first connector body 41. The engaging levers 42, 42 are independently turnably supported pivotally by pivots 44, 44 at the upper and lower surface of the first connector body 41. One ends of the engaging levers 42 project rearward from a rear end of the first connector body 41. Each of the engaging levers 42 is formed at its rear tip end with a first engaging projection 45 and a second engaging projection 46. Each of the second engaging projections 46 is located closer to a side of the first connector 40 (outer side in the widthwise direction of the first connector body 41) than a line connecting the first engaging projection 45 and the pivots 44. Each of the engaging levers 42 is formed at its front tip end with a connecting projection 47. Temporarily mounting projections 48 are formed on predetermined positions of the upper and lower surfaces of the first connector body 41. The temporarily mounting projection 48 and a peripheral edge 42A of the engaging lever 42 engage with each other, and the engaging lever 42 is temporarily mounted.

Figure 15:
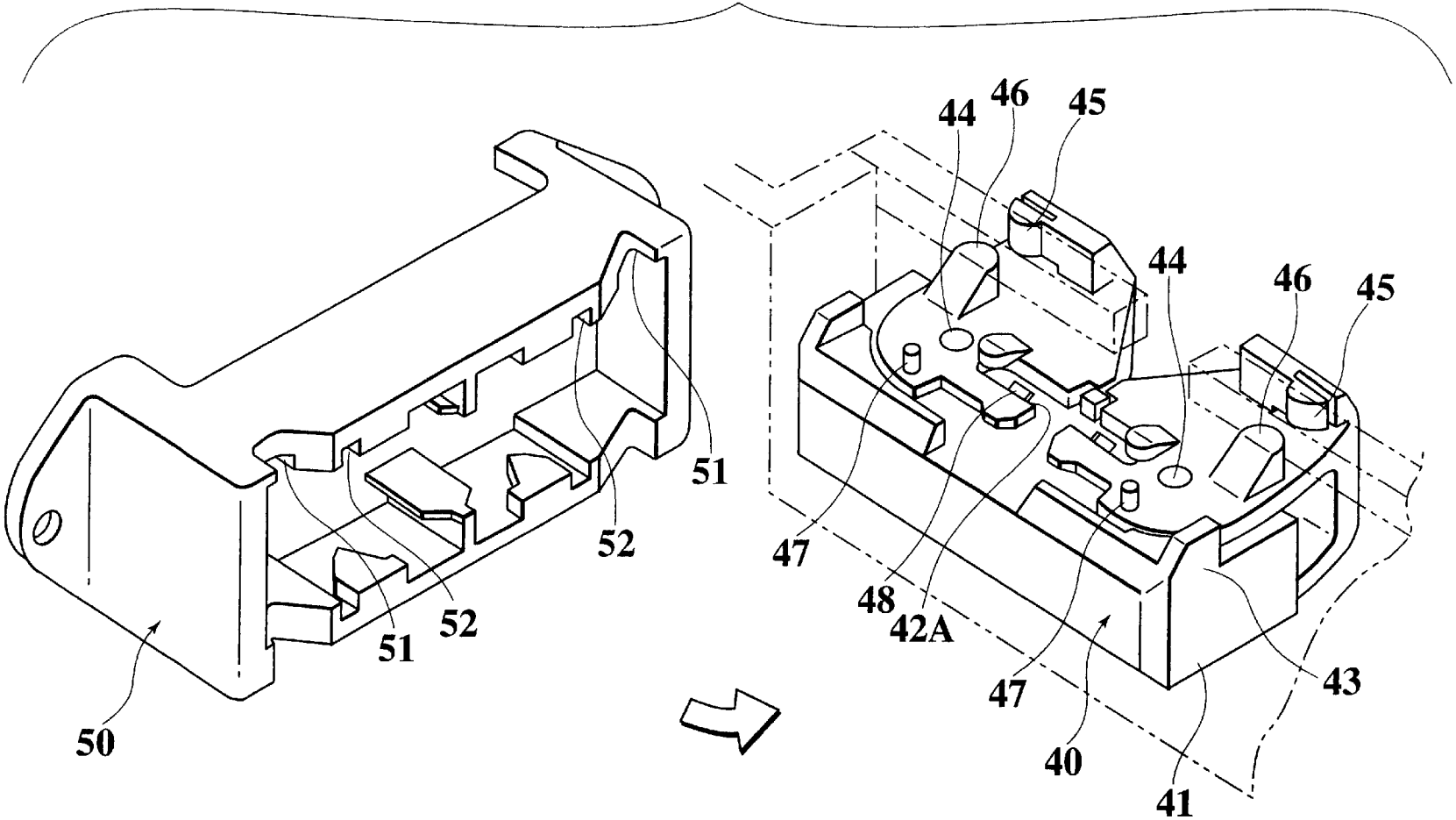
FIG. 15 is a perspective view showing a state where the second connector is mounted to the first connector in the second embodiment.

The second connector 50 is of substantially parallelepiped shape, and is provided with the plurality of female terminal metal fittings (not shown) which are coupled to the male terminal metal fitting t disposed in the first connector 40 by inserting the first connector 40 in the second connector 50. As shown in FIG. 15, guide grooves 52 corresponding to the guide projections formed in the first connector body 41 are formed on opposite sides of upper and lower inner wall surfaces of the second connector 50. Connecting grooves 52 extending inward from opening edges of the second connector 50 are formed in intermediate portions of the upper and lower inner wall surfaces. As in the above-described first embodiment, each of the connecting grooves 52 comprises an introducing groove 52 straightly extending inward from the opening edge, and a bending groove bending inward from the end of the introducing groove. The pair of connecting grooves 52 are formed in the inner wall surfaces of the second connector 50, and the bending grooves of the connecting grooves 52 are formed such that the bending grooves extend in a direction to approach each other.

Figure 14:
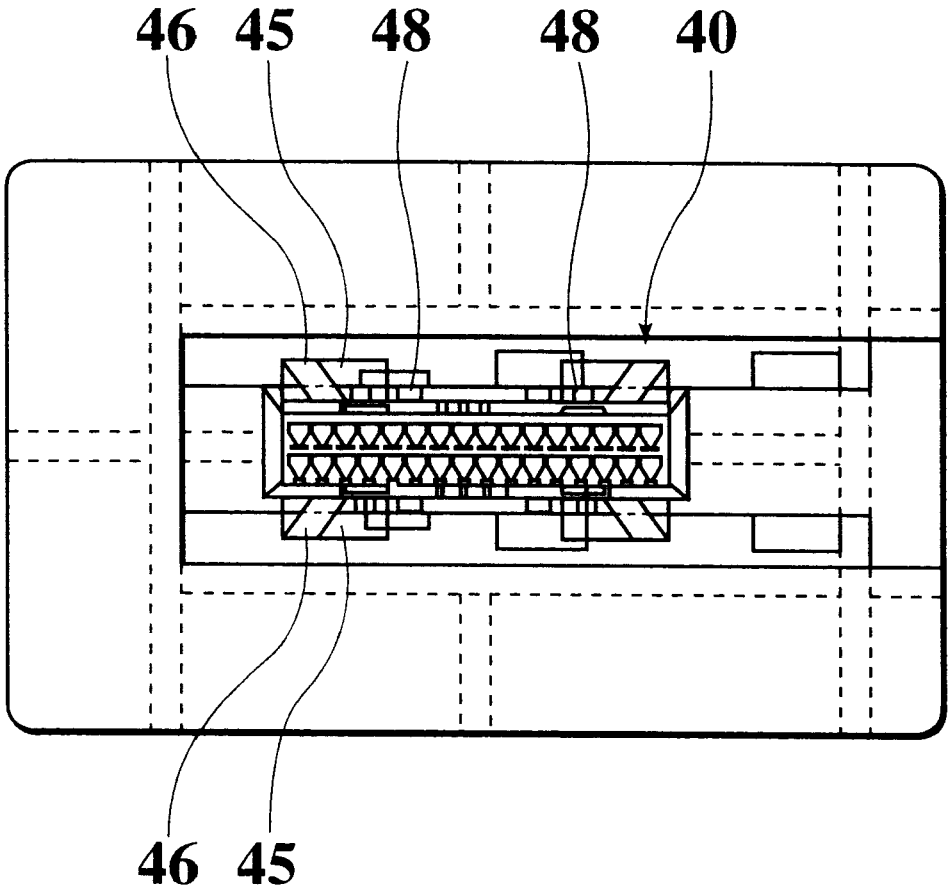
FIG. 14 is a front view showing the state where the first connector is temporarily mounted to the mounting member in the second embodiment.
Figure 16:
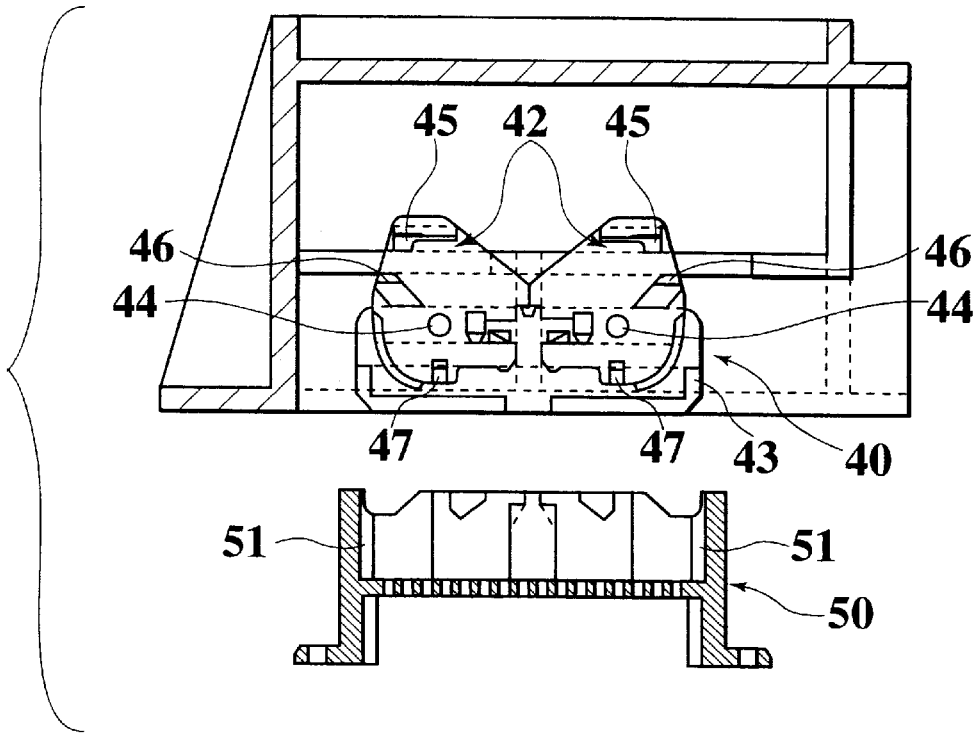
FIG. 16 is a partial sectional plan view showing the state where the second connector is mounted to the first connector in the second embodiment.
Figure 17:
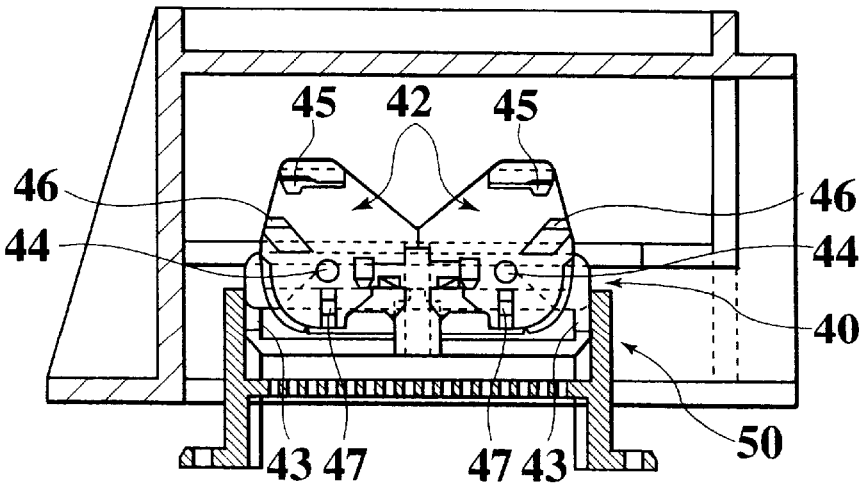
FIG. 17 is a partial sectional plan view showing the state where the second connector is mounted to the first connector in the second embodiment.
Figure 18:
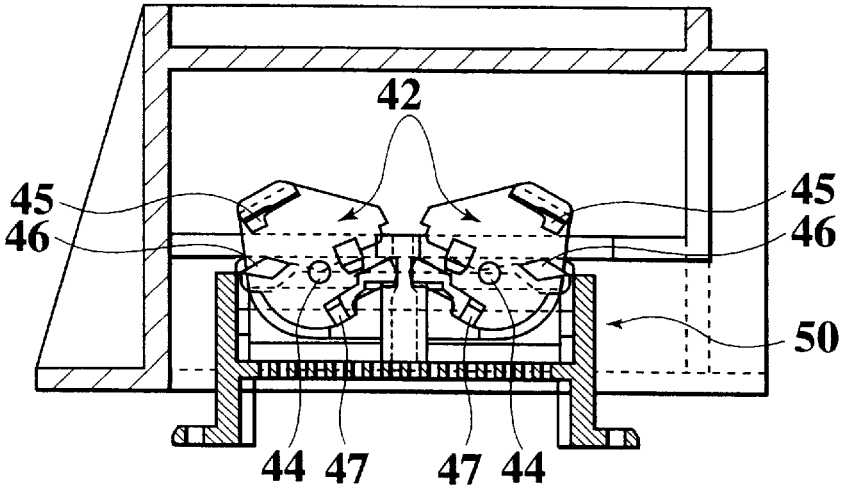
FIG. 18 is a partial sectional plan view showing the state where the second connector is mounted to the first connector in the second embodiment.

FIG. 16 shows a state before the first connector 40 is mounted to the mounting member. Next, as shown in FIG. 14, the second connector 50 is moved closer to the first connector 40 supported by the mounting member in a direction shown with the arrow, and the first connector 40 is mounted by the second connector 50 such that the guide projections 43 formed on the opposite sides of the upper surface of the front end of the first connector body 41 are fitted to the guide grooves 51 formed on the opposite sides of the upper inner wall surface of the second connector 50 (FIG. 17).

At that time, the connecting projections 47 formed on the engaging levers 42 slide and reach the entrance of the bending grooves (not shown) in a state where the connecting projections 47 are accommodated in the connecting grooves 52 formed in the upper inner wall surface of the second connector 50.

Figure 19:
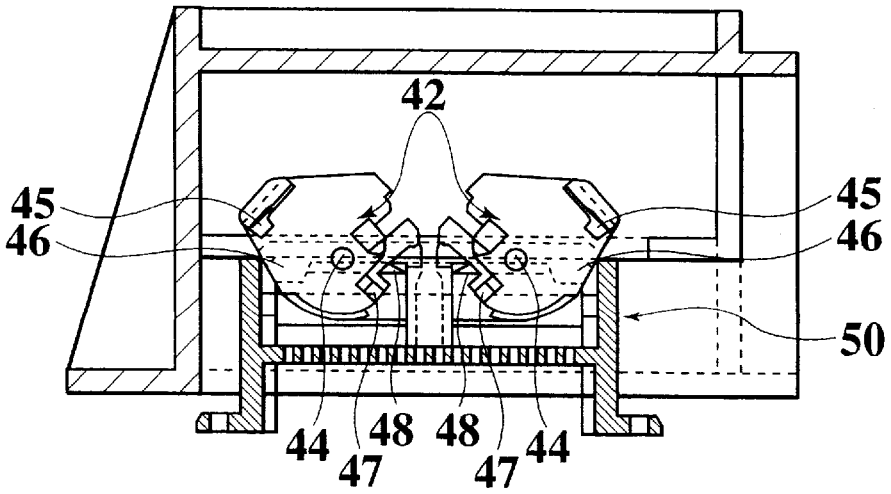
FIG. 19 is a partial sectional plan view showing a state where the second connector is completely fitted to the first connector in the second embodiment.

Thereafter, if the second connector 50 is further pushed and fitted to the first connector 40, the connecting projections 47 move along the bending surfaces of the bending grooves to turn the engaging levers 42, 42. These engaging levers 42, 42 rotate in a direction in which the first engaging projections 45 thereof are separating from each other in accordance with the shapes of the bending grooves. If the engaging levers 42 are turned while the first engaging projections 45 are separating from each other in this manner, the first connector 40 are pulled toward the mounting member around the pivot 44. If the second connector 50 is further pushed, the connecting projections 47 reach the terminal ends of the bending grooves as shown in FIG. 19, and with this movement, the engaging levers 42 are further rotated in the direction in which the first engaging projections 45 thereof are separating from each other. The engaging levers 42 ride over the temporarily mounting projections 48 projecting from the first connector body 41 and peripheral edges of the engaging levers 42 abut against the temporarily mounting projections 48, thereby preventing the engaging levers 42 from easily rotating reversely. In this state, the first connector 40 comes nearest to the mounting member, and the plate member of the stay member is sandwiched between the first engaging projection 45 and the second engaging projection 46, and the first connector 40 strongly fixed. In this state, the second connector 50 is completely fitted to the first connector 40, and the assembling operation is completed. As a result, the female terminal metal fittings t of the first connector 40 are coupled to the male terminal metal fittings of the second connector 50, and the electrical connection is established.

According to the second embodiment also, since the mounting member can be sandwiched and temporarily mounted between the first engaging projections 45 and the second engaging projections 46 projected from the rear end of the engaging levers 42, the mounting operation of the connectors is extremely easy, and the connector can be supported with a single motion. Further, in the second embodiment, the first connector 40 can be supported by and fixed to the mounting member 11 simultaneously only by fitting the second connector 50 to the first connector 40. Therefore, there is a merit that skill is not required for the operation, and the connectors can be supported reliably.

Although the first and second embodiments have been explained above, the present invention should not be limited to these embodiments, and various changes in design can be made in relation to the subject matter of the structure. For example, in the first and second embodiments, the pair of engaging levers are formed on the upper and lower opposite side surfaces of the first connector body, but if the pair of engaging levers are formed on at least one side surface, the first connector can be mounted stably.

What is claimed is:

1. A connector supporting mechanism, comprising:

a mounting member including a stay member provided with a mounting opening;

a first connector supported by the mounting member, the first connector comprising:

a connector body having an upper surface, a lower surface, a forward surface, and a rear surface; and a pair of engaging levers pivotably supported on at least one of the upper surface and the lower surface of the connector body, and partially projecting rearward of the rear surface of the connector body, each engaging lever comprising:

a plurality of engaging projections disposed on a first end of the engaging lever for engagement with the stay member; and at least one connecting projection disposed on a second end of the engaging lever; and a second connector to be fitted to the first connector, the second connector having guide grooves formed to receive and guide the connecting projections of the engaging levers of the first connector, wherein the guide grooves are formed such that advancement of the second connector towards the first connector in engagement with the stay member causes the second ends of the engaging levers to move together and the first ends of the engaging levers to move apart.

2. The connector supporting mechanism of claim 1, wherein the guide grooves are formed on an inner surface of the second connector.

3. The connector supporting mechanism of claim 1, wherein the engaging projections of each engaging lever comprise a first engaging projection and a second engaging projection between which the stay member is sandwiched.

* * * * *

UNITED STATES PATENT AND TRADEMARK OFFICE

CERTIFICATE OF CORRECTION

PATENT NO. : 6,276,948 B1
DATED : August 21, 2001
INVENTOR(S) : Toshiaki Okabe

It is certified that error appears in the above-identified patent and that said Letters Patent is hereby corrected as shown below:

Title page,
Item [57], ABSTRACT,
Line 5, "from one ends" should read -- from one end --.

Signed and Sealed this

Twenty-third Day of July, 2002

*Attest:*

*Attesting Officer*

JAMES E. ROGAN
*Director of the United States Patent and Trademark Office*